US010119741B2

(12) United States Patent
Jackson et al.

(10) Patent No.: US 10,119,741 B2
(45) Date of Patent: Nov. 6, 2018

(54) REFRIGERANT BUNKER AND COOLER EMPLOYING THE REFRIGERANT BUNKER

(71) Applicant: Cold Chain, LLC, Boise, ID (US)

(72) Inventors: Ronald S. Jackson, Boise, ID (US); Patrick Kilroy, Boise, ID (US); Daniel M. Aragon, Meridian, ID (US); John T. Prehn, Boise, ID (US); Todd J. Lindsey, Boise, ID (US); Peter James Wachtell, Boise, ID (US)

(73) Assignee: COLD CHAIN, LLC, Boise, ID (US)

( * ) Notice: Subject to any disclaimer, the term of this patent is extended or adjusted under 35 U.S.C. 154(b) by 333 days.

(21) Appl. No.: 14/789,465

(22) Filed: Jul. 1, 2015

(65) Prior Publication Data

US 2017/0003063 A1 Jan. 5, 2017

(51) Int. Cl.
*F25D 3/08* (2006.01)

(52) U.S. Cl.
CPC ..... *F25D 3/08* (2013.01); *F25D 2303/082* (2013.01); *F25D 2303/0832* (2013.01); *F25D 2303/0843* (2013.01); *F25D 2303/0844* (2013.01)

(58) Field of Classification Search
CPC ..... F25D 3/08; F25D 2303/082; F25D 2303/0844; F25D 3/12; F25D 3/125; F25D 3/06
See application file for complete search history.

(56) References Cited

U.S. PATENT DOCUMENTS

| | | | |
|---|---|---|---|
| 2,850,885 | A | 9/1958 | Mohr et al. |
| 2,869,331 | A | 1/1959 | Koon |
| 3,922,878 | A | 12/1975 | Jalali |
| 3,971,231 | A | 7/1976 | Derry |
| 5,363,670 | A | 11/1994 | Bartilucci |
| 5,598,713 | A | 2/1997 | Bartilucci |
| 5,979,173 | A | 11/1999 | Tyree |
| 6,212,901 | B1 | 4/2001 | Pint et al. |
| 6,751,963 | B2 | 6/2004 | Navedo et al. |
| 7,310,967 | B2 | 12/2007 | Aragon |

(Continued)

OTHER PUBLICATIONS

Peter James Wachtell, "Insulated and Ventilated Refrigerant Bunker", U.S. Appl. No. 14/565,999, filed Dec. 10, 2014.

(Continued)

*Primary Examiner* — Elizabeth Martin
(74) *Attorney, Agent, or Firm* — MH2 Technology Law Group LLP

(57) ABSTRACT

A refrigerant bunker comprises a refrigerant covering comprising a first thermally insulating material configured to enclose a solid refrigerant and an outer container comprising a container body and a container cover. The container body comprising an outer surface, an inner surface defining a partially enclosed space configured to accept the solid refrigerant and an opening for accessing the partially enclosed space. The container cover is configured for covering the container opening. The container body comprises a second thermally insulating material. A plurality of spacers protrude from the inner surface of the outer container in the partially enclosed space. The plurality of spacers are positioned to have gas fillable gaps between the spacers. Coolers employing the refrigerant bunker are also disclosed.

20 Claims, 9 Drawing Sheets

(56) References Cited

U.S. PATENT DOCUMENTS

| | | | | |
|---|---|---|---|---|
| 8,191,380 | B2 | 6/2012 | Aragon | |
| 2006/0230778 | A1* | 10/2006 | Williams | B65D 81/3862 62/371 |
| 2011/0232303 | A1* | 9/2011 | Whewell, Jr. | F25D 3/122 62/62 |

OTHER PUBLICATIONS

Author Unknown, "Commercial Building Wrap for Durability and Energy Efficiency", DUPONT™ TYVEK® COMMERCIALWRAP®, http://www.dupont.com/products-and-services/construction-materials/building-envelope-systems/brands/air-barrier-systems/products/tyvek-commercialwrap-building-wrap.html, accessed Jun. 12, 2015, pp. 1-3.

* cited by examiner

REFRIGERANT BUNKER AND COOLER EMPLOYING THE REFRIGERANT BUNKER

DETAILED DESCRIPTION

Field of the Disclosure

A refrigerant bunker for use with solid refrigerants and a cooler employing the refrigerant bunker.

Background

Insulated containers are used for the transportation of refrigerated and frozen products, and are used in many industries for shipping a wide variety of temperature sensitive products. Additionally, consumers and businesses often use insulated portable, and/or personal coolers, such as ice chests, to transport refrigerated food, frozen food, beverages and a wide spectrum of temperature sensitive products so that they may be stored, sold, enjoyed and/or consumed at specific temperatures, and to prevent spoilage until the products are used.

Based on the desired temperature for a specific product, a user may choose to use a refrigerant such as water ice, gel packs, or dry ice. Each of these refrigerants has a distinct temperature range that it operates within. Water ice operates at a temperature of about 33 degrees Fahrenheit (° F.) and maintains that temperature by changing phases (solid to liquid). Gel packs, also referred to as "ice packs," are engineered to maintain a similar temperature, but can range from approximately 5 to 50° F. Finally, dry ice sublimates at a temperature of about minus 110° F. Thus, dry ice is known for use as a refrigerant when the product temperature is desired to be in a very low range.

For cooling product at temperatures above freezing, dry ice is often not an acceptable refrigerant. For example, the extreme cold temperatures produced by sublimating dry ice can freeze the contents of beverage containers, such as soda cans, resulting in the beverage container losing its integrity. Likewise, fresh fruits, vegetables, sandwiches, and the like often cannot be packed directly in dry ice because if such foods freeze solid it can affect palatability.

Using dry ice in an insulated bunker as a source of refrigerant to maintain cool or cold temperatures inside of temperature controlled containers is well known. Dry ice cooling techniques often involve insulating the dry ice from the interior of the temperature controlled container while regulating the flow of sublimated $CO_2$ gas into the temperature controlled container as a means of regulating the cooler temperature. This technique works well for larger, commercial type coolers, where the size of the cooler is relatively large compared to the size of the solid refrigerant bunker. However, for smaller, portable type coolers, it can be difficult or impossible to control the temperature of the cooler in order to maintain a temperature that is much warmer than the refrigerant sublimation temperature by regulating convective carbon dioxide gas flow. Further, limiting conductive heat transfer in such convection controlled systems can involve employing large amounts of insulation surrounding the dry ice refrigerant, which increases costs and takes up relatively large amounts of the space.

U.S. Pat. No. 6,212,901 discloses a cooler with a chamber and a cavity in its lid. A block of dry ice is inserted into the cavity. Heat transfers from the chamber through a heat transfer element, such as a plate of aluminum, connecting the chamber to the cavity. The rate of this heat transfer is regulated by covering or uncovering the heat transfer element in the chamber side. However, integrating a separate heat transfer element into the cooler can cause increased fabrication complexity and expense. Further, this design has the undesirable potential of excessively cooling any materials that are too near, or come in contact with, the heat transfer element.

Thus, an improved cooler design that employs a sublimating refrigerant, such as dry ice, would be a welcome addition to the art.

SUMMARY

An embodiment of the present disclosure is directed to a refrigerant bunker. The refrigerant bunker comprises a refrigerant covering comprising a first thermally insulating material configured to enclose a solid refrigerant and an outer container comprising a container body and a container cover. The container body comprising an outer surface, an inner surface defining a partially enclosed space configured to accept the solid refrigerant and an opening for accessing the partially enclosed space. The container cover is configured for covering the container opening. The container body comprises a second thermally insulating material. A plurality of spacers protrude from the inner surface of the outer container in the partially enclosed space. The plurality of spacers are positioned to have gas fillable gaps between the spacers.

Another embodiment of the present disclosure is directed to a cooler. The cooler comprises a thermally insulated receptacle comprising one or more sides and a bottom defining a chamber and an opening for accessing the chamber. The sides and bottom comprise a thermally insulating material. A lid comprises a thermally insulating material for covering the opening. The lid is positionable in an open position that allows access to the chamber and a closed position that prevents access to the chamber; A refrigerant bunker is positionable in the cooler. The refrigerant bunker comprises a refrigerant covering comprising a first thermally insulating material configured to enclose a solid refrigerant; and an outer container comprising a container body and a container cover. The container body comprises an outer surface, an inner surface defining a partially enclosed space configured to accept the solid refrigerant and an opening for accessing the partially enclosed space. The container cover is configured for covering the container opening. The container body comprises a second thermally insulating material. A plurality of spacers protrude from the inner surface of the outer container in the partially enclosed space. The plurality of spacers are positioned to have gas fillable gaps between the spacers.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrates embodiments of the present teachings and together with the description, serve to explain the principles of the present teachings.

Figure 2:
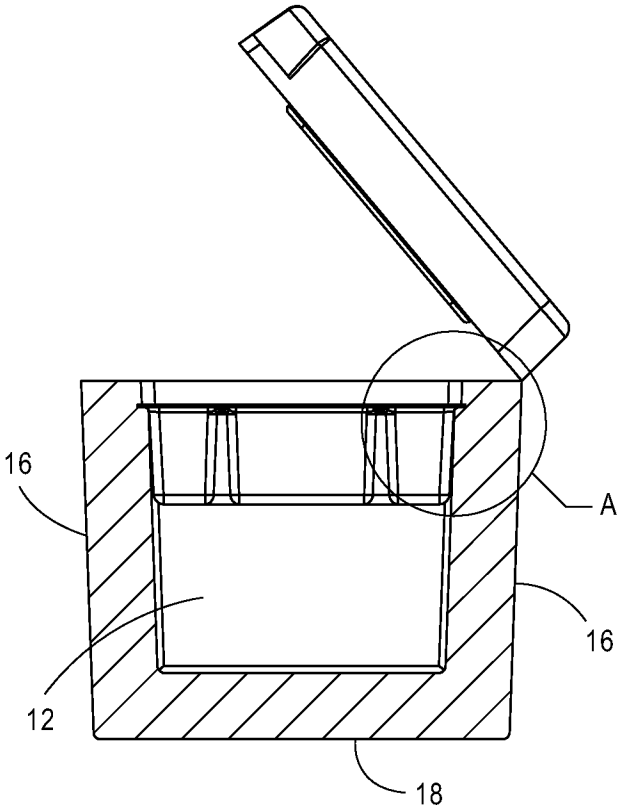
FIG. 2 illustrates a cross sectional view of the cooler and refrigerant bunker of FIG. 1, according to an embodiment of the present disclosure.

It should be noted that some details of the figure have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. In the drawings, like reference numerals have been used throughout to designate identical elements. In the following description, reference is made to the accompanying drawing that forms a part thereof, and in which is shown by way of illustration a specific exemplary embodiment in which the present teachings may be practiced. The following description is, therefore, merely exemplary.

Figure 1:
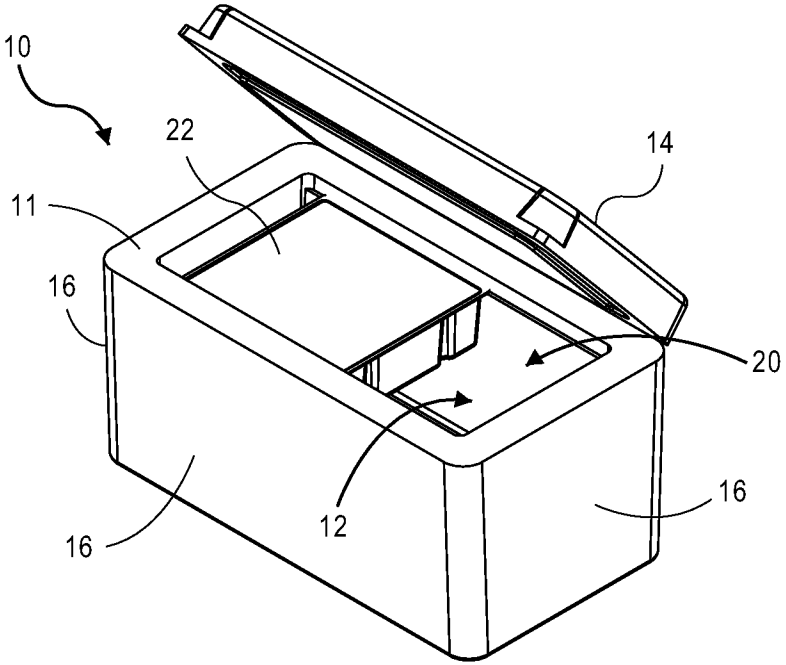
FIG. 1 illustrates a perspective view of a cooler including a refrigerant bunker, according to an embodiment of the present disclosure.

FIG. 1 illustrates a cooler 10, according to an embodiment of the present disclosure. Cooler 10 includes a receptacle 11 having a chamber 12 and a lid 14. Receptacle 11 comprises one or more sides 16 and a bottom 18 (shown more clearly in FIG. 2) that define the chamber 12. An opening 20 allows access to the chamber 12. Lid 14 is positionable in an open position that allows access to the chamber 12, as shown in FIG. 1. The lid 14 is designed to engage and cover the opening 20 when in a closed position, so as to prevent access to the chamber 12. The lid 14, sides 16 and bottom 18 comprise a thermally insulating material, such as foam and/or plastic.

A refrigerant bunker 22 is positionable in the cooler 10. FIG. 3A illustrates an exploded view of a refrigerant bunker 22, according to an embodiment of the present disclosure. Refrigerant bunker 22 includes an inner refrigerant covering 24 and an outer container 26 that includes a container body 27 and a container cover 28. The container cover 28 can be, for example, a lid or flap that is designed to engage and cover an opening 30 of the outer container.

Inner refrigerant covering 24 is configured to hold a refrigerant 32. The refrigerant can include any suitable cold source, such as water ice, gel packs, and dry ice. The dry ice can be in any suitable form, such as solid brick or pelletized form. Although dry ice is frequently referred to herein, a skilled artisan will be able to select an appropriate refrigerant for insertion into the enclosed space in a particular embodiment based on various considerations, including the intended use of the refrigerated bunker, the intended arena within which the refrigerated bunker will be used, and the equipment and/or accessories with which the refrigerated bunker is intended to be used, among other considerations. In an embodiment, the refrigerant is dry ice, which can provide dry cooling to a range of temperatures when use in combination with the refrigerant bunker of the present disclosure. It is noted that more than a single type of coolant can be used in a single cooler. For instance, dry ice can be used in combination with water ice, such as where dry ice is used in a refrigerant bunker while water ice is employed in the cooler chamber 12.

The dry ice can have any suitable size or shape, as can the inner refrigerant cover 24 and outer container 26. In an embodiment, the inner refrigerant cover 24 is in the form a sleeve, as shown in FIG. 3A. The size and shape of the sleeve can be made to hold one or more standard dry ice sizes. An opening 34 in the sleeve allows for insertion of the solid refrigerant 32 into the sleeve. A sleeve cover, shown as a flap 36, for covering the sleeve opening 34 is illustrated in an open position in FIG. 3A. Flap 36 is shown in a closed position in FIG. 3B. When in the closed position, the flap 36 can be fastened shut using a hook and loop type fastener 37, snap or any other suitable fastener.

In an embodiment, the inner refrigerant cover 24 can be made from a pliable, thermally insulating material. In an embodiment the material is a polymer, such as polymeric foams and plastics. One example is spun-bonded polyethylene, (a commercial example of which is TYVEK, made by DuPont). Other examples of suitable polymer materials include foam rubber, plastic films, molded plastics, corrugated plastic and bubble wrap, including metal covered bubblewrap, such as aluminum foil covered Mylar bubble wrap. Still other example materials include single-layers or multiple-layers of paper or textiles, such as corrugated paper, paper sheets or cloth, such as nylon or coated nylon. In an embodiment, the material is permeable to gas vaporizing from the solid refrigerant, such as carbon dioxide gas, to allow venting of the gas through the material. In other embodiments, the material may be substantially impermeable.

Figure 4:
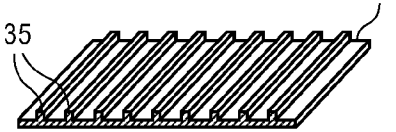
FIG. 4 illustrates a cross section of an inner refrigerant cover, according to an embodiment of the present disclosure.

The structure of the inner refrigerant cover 24 can vary widely. In an embodiment, the structure results in increased ability to allow the creation of layers of sublimating carbon dioxide gas around the refrigerant. For example, the inner refrigerant cover can be a single layer or multiple layers of a suitable insulating material, such as a sheet of the desired material that is designed to wrap around the refrigerant. Examples include a sheet of paper, foam rubber or plastic that has a sufficient size to completely or partially surround the refrigerant when the refrigerant is wrapped therein. An example is shown in FIG. 4, which shows an inner refrigerant cover 24 in the form of a wrap 33 having protrusions 35 designed to create fillable gas pockets between the refrigerant 32 and the inner refrigerant cover 24. The protrusions 35 can be in any desired pattern that will aid in trapping sublimating gas to form gas pockets or layers between the inner refrigerant cover and the refrigerant. While a primary purpose of the protrusions is to create areas to trap gas, a secondary purpose is to reduce direct contact area between the inner sleeve and the refrigerant so as to reduce direct conduction paths. Rather than protrusions, the inner refrigerant cover can be shaped with folds or indentations capable of trapping gas, or may be made from any other suitable material designed to trap gas.

The insulating properties, gas permeability and number of material and gas layers used in the inner refrigerant cover may be varied to provide corresponding differentiated levels of cooling and will depend on the type of outer container in which the inner refrigerant cover is used (e.g., hard plastic outer container vs. pliable material/fabric outer container). Inner refrigerant cover 24 can comprise one or more layers, such as two or three layers, of insulating material and/or gas. The materials can have limited ability to act as a barrier to thermal energy transfer and also as a barrier to the flow of carbon dioxide sublimate through the inner refrigerant cover material itself. In general, inner refrigerant cover 24 is designed to aid in maintaining the temperature inside the cooler 10 by helping to regulate, in combination with the outer container 26, the amount of thermal energy that is removed from the cooler chamber and absorbed by the dry ice refrigerant.

Container body 27 includes an outer surface 38 and an inner surface 40. The inner surface 40 defines a partially enclosed space for holding the inner refrigerant cover 24 and/or the refrigerant 32. The container body 27 can include one or more material and gas layers to control both the transfer of thermal energy and the release of carbon dioxide gas from the container body. In an embodiment, no ventilation port is required and the container body 27 is not required to be airtight or sealed from the outside space adjacent to the refrigerant bunker.

Figure 3B:
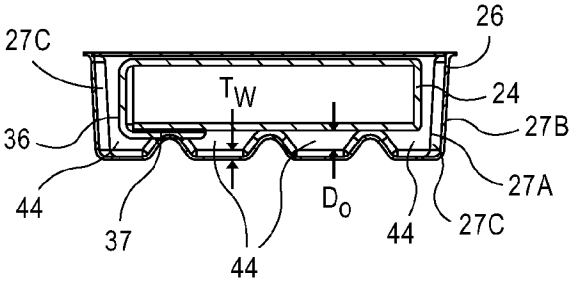
FIG. 3B illustrates a cross sectional view of the refrigerant bunker of FIG. 3A, according to an embodiment of the present disclosure.
Figure 3A:
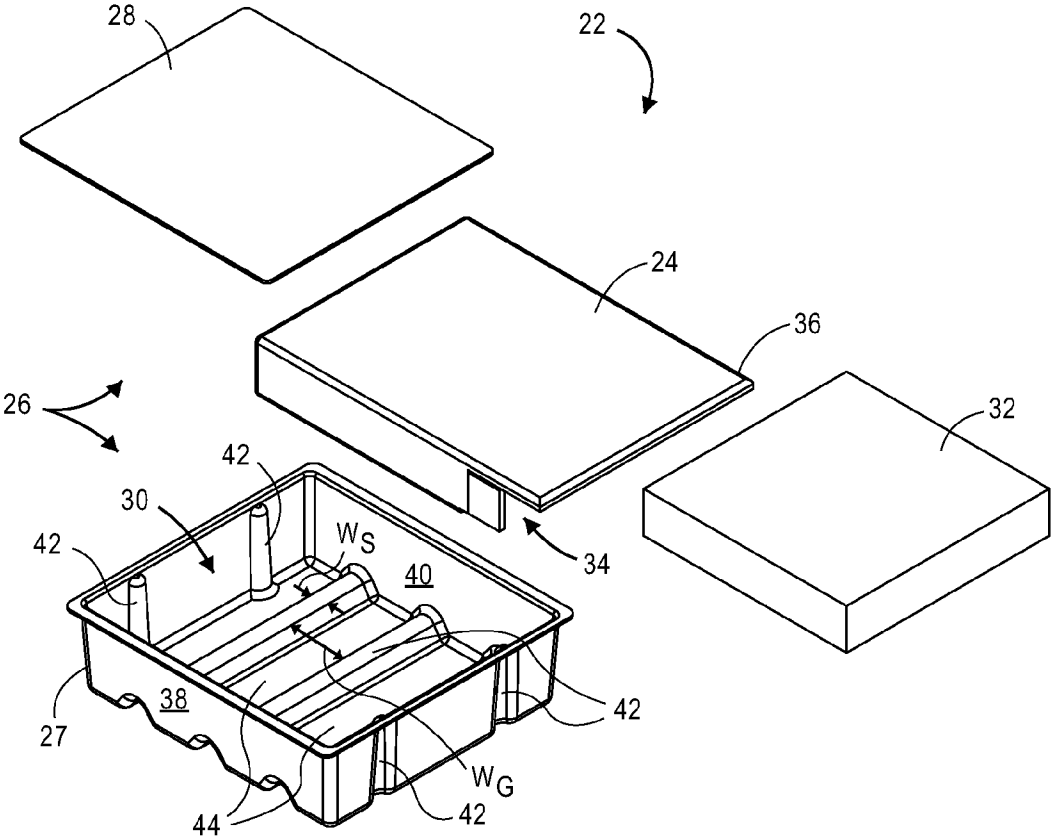
FIG. 3A illustrates an exploded view of the refrigerant bunker of FIG. 1, according to an embodiment of the present disclosure.

While a generally right, rectangular parallelepiped shape is utilized for the exemplary outer container 26 in FIGS. 3A and 3B, illustration of such a shape is not intended as a limitation on possible shapes or configurations for the refrigerant bunker. The shape of the container 26 can be made to suit any readily available refrigerant shapes and sizes (e.g., rectangular blocks, pellets and so forth.) A skilled artisan will be able to select an appropriate material, shape and configuration for an exemplary refrigerated bunker in a particular embodiment based on various considerations, including the intended use of the refrigerated bunker, the intended arena within which the refrigerated bunker will be used, and the equipment and/or accessories with which the refrigerated bunker is intended to be used, among other considerations. For instance, an exemplary outer container and the associated inner refrigerant cover 24 can both be generally cylindrically shaped, comprising two faces—a top face and a bottom face, wherein the top face and bottom face run parallel thereto and are connected by an elongated circular sleeve, which defines an inner, enclosed space. Alternatively, an exemplary outer container 26 and inner refrigerant cover 24 can both be in the general shape of a hexagonal prism, or a sphere, or a pyramid, or a bag, or a box, or any other suitable shape or configuration. In an embodiment, the container body 27 can be shaped so as to be stackable for ease of shipping.

In an embodiment, a plurality of spacers 42, such as those illustrated in FIG. 3A, are integrated into the container body 27 so at to extend between the inner refrigerant cover 24 and the outer container 26 when the inner refrigerant cover is inserted into the container. The spacers 42 are positioned to form gaps 44 between the spacers. The spacers can be made of the same insulating material or a different insulating material as that of the container body 27.

In an embodiment, the outer container body 27 and cover 28 comprise a thermally insulating material that is substantially less permeable, such as relatively impermeable, to carbon dioxide gas compared with the thermally insulating material used to form the inner refrigerant cover 24. Alternatively, the material for the outer container body may have the same permeability or an increased permeability relative to the material of the inner refrigerant cover 24. In an embodiment, the outer container body 27 and/or lid 28 comprise a rigid or pliable plastic that can provide the desired reduced permeability and structural stability under extremely cold conditions. Examples of suitable plastics include high molecular weight plastics, such as ultrahigh molecular weight polyethylene, high density polyethylene ("HDPE") or foam rubbers, such as high density polyurethane foam. Other materials could include woven fabrics, such as Nylon fabric, rubber and/or composite materials. The materials used for the outer container body 27 and lid 28 can be the same or different. The material selected to construct the outer container 26 may be rigid, semi-rigid or flexible, and may depend upon the refrigerant bunker's ultimate use, for example, military combat use or recreational consumer applications such as backpacking or picnic use.

In an embodiment, the use of thermally conductive materials is avoided in making the inner refrigerant cover and/or the outer container. For example, the inner refrigerant cover 24 and outer container 26 can include no metal. In other embodiments, metal may be employed in a suitable manner so as not to affect the insulation properties of the refrigerant bunker by an unacceptable degree.

In an embodiment, outer container 26 includes only a single layer of thermally insulating material, such as a plastic as described above. In another embodiment, multiple layers can be used. For instance, the outer container 26 can comprise a layered sandwich type structure. For example, referring to FIG. 3B, outer container 26 can include an inner layer 27A and an outer layer 27B that are spaced apart. The inner layer 27A and outer layer 27B can include the same or different materials, including any of the materials discussed herein for use with outer container 26. For example, both can be made of the same or different plastic, such as any of the plastics discussed herein for use with the outer container 26. An insulating layer 27C can be positioned between the inner layer 27A and the outer layer 27B. The insulating layer 27C can be any suitable material, including a high R value solid, such as a foam, or a gas filled space, such as air, nitrogen or a vacuum. The insulative substance layer fills all or a portion of the space between inner layer 27A and outer layer 27B.

The sides and bottom of the outer container body 27 can be relatively thin, due at least in part to the improved design of the bunker that utilizes the gaps 44 between the refrigerant and the bunker wall as a trapped gas insulation layer. This allows relatively small amounts of insulating material to be employed while still providing the desired insulation of the refrigerant 32 from the outside atmosphere. For example, the outer container sides and/or bottom can have a wall material thickness, $T_w$, (excluding the gap 44) that is one inch thick or less, such as about 1/16 inch to about 3/4 inch, or about ⅛ inch to about ¼ inch or ½ inch. Thicknesses outside these ranges can be employed. Employing the gaps 44 with relatively thin walls can provide for a less bulky container, which is less expensive and takes up a relatively small amount of cooler space. For example, for a 10×10×2 sized refrigerant having a volume of about 200 $in^3$, the refrigerant bunker may occupy a total volume of space inside the cooler of about 300 to about 400 $in^3$ or possibly 600 $in^3$, depending on the materials employed, the size of the gaps 44 and the desired insulation properties of the bunker. Thus, the increase in volume relative to the refrigerant volume can range, for example, from about a 50% to about a 200% increase, and may be less than 100% for some bunker designs.

In an embodiment, the decreased permeability of outer container 26 allows the carbon dioxide gas leaking from the inner refrigerant cover 24 to remain trapped in the outer container 26 for a period of time. The carbon dioxide gas can fill gaps 44 so as to surround the inner refrigerant cover 24 and may also provide carbon dioxide filled spaces in the inner refrigerant cover 24 itself, depending on design of the inner refrigerant cover. Carbon dioxide gas has a relatively low thermal conductivity (e.g., lower than the thermal conductivity of air at temperatures near freezing). Thus, the formation of layers of carbon dioxide gas in outer container 26 and/or inner refrigerant cover 24 can act as an insulator to thermally insulate the refrigerant 32 from outside warmer air and heat that would otherwise be conducted through the outer container 26. The increased insulation can extend the useful life of the refrigerant 32 and allow an increased temperature (e.g., above freezing) to be maintained inside the cooler chamber 12.

Because the outer container 26 completely surrounds the refrigerant, and because the refrigerant bunker 22 results in a reduced rate of sublimation of gas from the refrigerant compared to dry ice without the refrigerant bunker, refrigerant bunker 22 can significantly reduce any cooling effect that may be caused by the flow of carbon dioxide gas from the refrigerant bunker 22 compared to the cooling effect produced by thermal conduction through the refrigerant bunker 22. Thus, while not intending to be limited by theory, it is believed that the primary mechanism for cooling employed when using refrigerant bunker 22 is by conduction through the outer container 26 and inner refrigerant cover 24.

Referring again to FIGS. 3A and 3B, the spacers 42 and gaps 44 can be designed to increase or decrease the offset distance, $D_o$, which is the depth of the gaps from a line parallel with the tops of the spacers 42 to the bottom of the gap (where the bottom of each gap is the inner surface 40 from which the spacers forming that gap extend), as measured at the greatest offset distance for each gap. By increasing the distance, $D_o$, the distance between the refrigerant 22 and the sides and bottom of the outer container 26 at the gaps 44 can effectively be increased, thereby increasing the R value of the refrigerant bunker. $D_o$ can be chosen to have any suitable values, such as, for example, about ¼ inch to about 2 inches, or about ⅜ inch to about 1 inch.

Additionally, the amount of contact surface area between outer container 26 and the inner refrigerant cover 24 can also be determined by the number and shape of the spacers 42. For example, by reducing the contact surface area between the outer container 26 and the inner refrigerant cover, thermal conduction can be reduced, which can also effectively increase the R value of the refrigerant bunker. Thus, the particular size, shape and number of the spacers 42 and gaps 44 can be chosen to vary the effective R value of the bunker and control the cooler temperature. For example, the width, $W_G$, of the gaps 44 between adjacent spacers 42, as measured at the tops of the spacers can generally be greater than the width, $W_S$, of the top most surface of the spacers 42, so that the total area of the gaps 44 at the tops of the spacers is relatively large compared to the area of the top surfaces of the spacers. In an example, the ratio of $W_G$ to $W_S$ can be more than 2:1, such as 3:1 to about 1000:1 or more, or 4:1 to about 100:1. Example ratios of the total area of the gaps 44, as measured in an imaginary plane that extends across the tops of the spacers, to the total area of the top most surface of the spacers extending from the bottom of the outer container can range from about 2:1 to about 1000:1 or more, such as about 3:1 to about 10:1 or 50:1.

In addition to the insulation value provided by the outer container 26, there is an increased insulating ability provided by the inner refrigerant cover 24, which can also result in a significant increase in the life of the refrigerant and its ability to maintain a relatively constant cold temperature. In an embodiment, the inner refrigerant cover 24 is removable from the outer container 26, as shown in FIG. 3A. Because the inner refrigerant cover can be designed to provide significant insulation value, such as through additional layers of carbon dioxide gas trapped inside the inner refrigerant cover and/or by using a thermally insulating material with a high R value, the ability to remove the inner refrigerant cover can increase flexibility in temperature control of the cooler. For example, in an embodiment, the refrigerant bunker 22 be designed to provide temperatures in the cooler chamber suitable for refrigeration (e.g., 33° F. to about 40° F.) when used with the inner refrigerant cover 24; and to provide below freezing temperatures in the cooler (e.g., about 20° F. to 32° F.) when used without the inner refrigerant cover (e.g., dry ice without the inner refrigerant cover is inserted into the outer container 26). Thus, a user can choose to use the cooler as either a refrigerator or freezer simply by using the refrigerant bunker 22 with or without the inner refrigerant cover 24.

Figure 6:
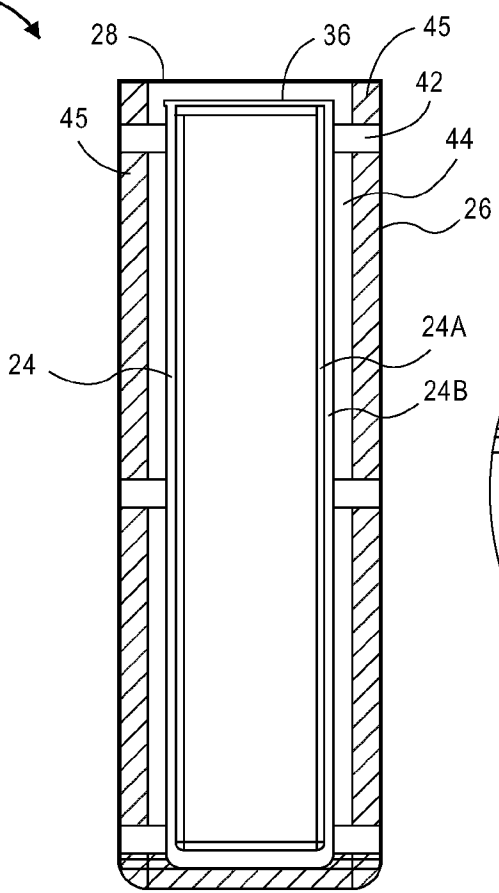
FIG. 6 illustrates a cross sectional view of a refrigerant bunker, according to an embodiment of the present disclosure.
Figure 5:
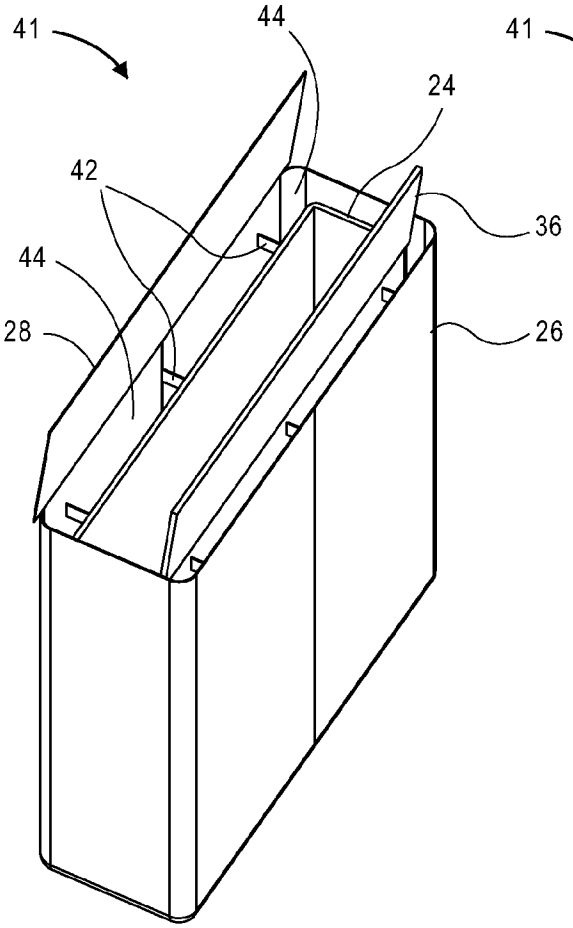
FIG. 5 illustrates a perspective view of a refrigerant bunker, according to an embodiment of the present disclosure.

FIGS. 5 and 6 illustrate embodiments of a refrigerant bunker 41 in which the outer container 26, in the form of a sleeve, comprises a pliable material. In some embodiments, this can allow the refrigerant bunker to be folded or otherwise compacted to fit into a small space when not in use. The ability to employ pliable materials can also allow for a wide variety of materials and designs to be employed in the manufacture of the refrigerant bunkers of the present disclosure. Examples of suitable pliable materials include plastics, such as nylon, that can be in the form of pliable films or fabrics, or polymer coated fabrics such as polymer coated nylon fabric.

The inner refrigerant cover of FIG. 6 is shown as having two or more different insulating layers 24*a* and 24*b*, either of which can be any of the insulating materials described herein for use with an inner refrigerant cover. Alternatively, the inner refrigerant cover can include only a single layer of insulating material.

Spacers 42 are also made from a pliable, thermally insulating material, such as plastic or cloth. The inner refrigerant cover 24, as described above, is attached in any suitable manner to the outer container 26 by spacers 42. For example, the inner refrigerant cover can be fixedly attached to the outer container using any suitable technique, such as by sewing, plastic welding or using an adhesive to attach the spacers 42 to both the inner refrigerant cover and the outer container. Alternatively, the inner refrigerant cover can be removably attached to the outer container, such as by using VELCRO or snaps.

In an embodiment, the material of inner refrigerant cover 24 is relatively permeable to sublimating gases compared to the outer container 26. Alternatively, the material of inner refrigerant cover 24 can have about the same permeability or a reduced permeability relative to the permeability of the outer container 26. The materials and design of the outer container 26 and inner refrigerant cover 24 can be chosen to provide a desired permeability that allows refrigerant gas to fill spaces between the inner refrigerant cover 24 and the refrigerant 32 and/or to pressurize gaps 44. Thus, during use, sublimating gas from the refrigerant can fill the gaps 44 sufficiently so as to maintain a carbon dioxide gas filled space between the inner refrigerant cover 24 and outer container 26. In this manner, the gas filled gaps 44 provide enhanced thermal insulation.

Referring to FIG. 6, the refrigerant bunker can include an internal frame 45 over which the pliable material of outer container 26 can be fastened. The internal frame can be designed to provide structural support to the refrigerant bunker 41 and can be made of any suitable material that will provide the desired support. One of ordinary skill in the art would readily be able to determine a suitable design and materials for constructing the frame 45. Alternatively, refrigerant bunker 41 can be made without an internal frame 45, as in the embodiment of FIG. 5.

In any of the refrigerant bunkers described herein, a pressure release mechanism can optionally be included to vent over-pressurization of the sublimated gas from the outer container 26. In an embodiment, the pressure release mechanism can include, for example, a pressure regulating valve and/or built in leak paths in the container. Such leak paths can include, for example a loose fitting container cover 28, to provide the desired venting between the cover 28 and the container body 27. In an embodiment, gas leakage through a hook and loop type fastener, such as VELCRO®, that is employed to fasten the cover 28 to the body of the outer container 26 can provide the desired leakage path. Any other suitable leakage path that can maintain the desired pressure range of carbon dioxide gas in the refrigerant bunker can be employed, such as by leakage through seams between container pieces, or the permeability of the container materials. In an embodiment, the desired pressure levels, which may be approximately the same as ambient pressures (e.g., about 1 atmosphere) or any desired amount above ambient pressures, are maintained using built in leak paths, such as through use of permeable materials, seams and/or or fasteners such as VELCRO, and no additional convection ports or valves are employed in either the inner refrigerant cover 24 or container 26. In an embodiment, forced convection is not used to move refrigerant gases (e.g., carbon dioxide sublimated from dry ice) into or out of the refrigerant bunker. For example, no fans or other gas moving devices are employed in the bunkers 22 or coolers 10 of the present disclosure.

Figure 7:
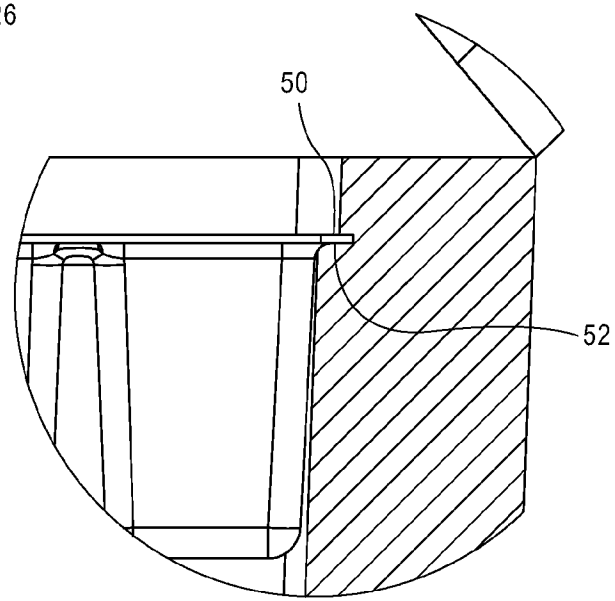
FIG. 7 illustrates a close up view of detail A of the cooler and refrigerant bunker of FIG. 2, according to an embodiment of the present disclosure.

In an embodiment, the outer container 26 comprises a releasable mounting fixture or unfixed platform for mounting said refrigerated bunker within the cooler 10. For example, as shown in FIG. 7, the refrigerant bunkers of the present disclosure can include a lip 50 that can be used to suspend the refrigerant bunker from a ledge 52 in cooler 10. Any other suitable type of mounting device and/or fastener can optionally be used for fixing the refrigerant bunkers of the present disclosure in position in a cooler.

Figure 8:
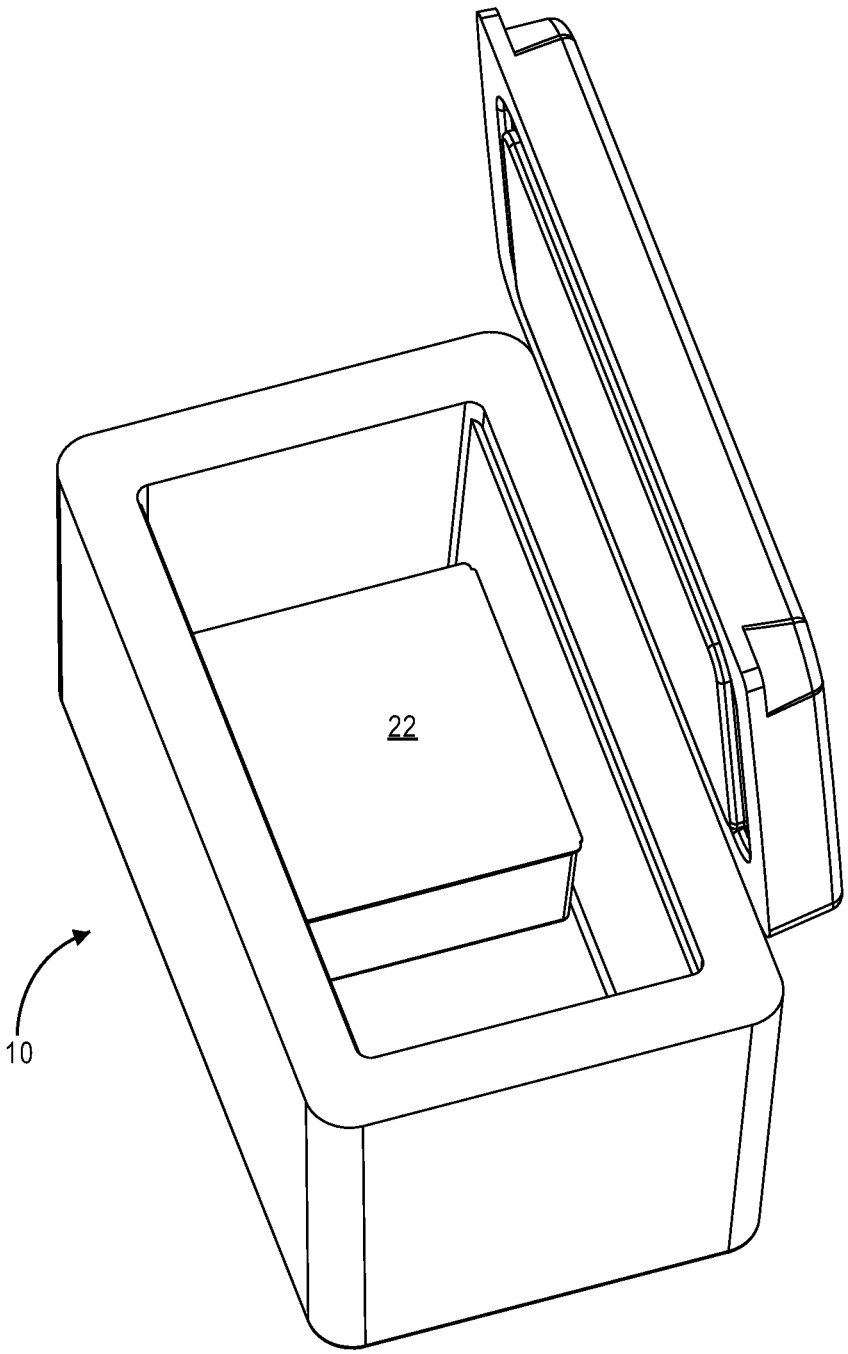
FIGS. 8 and 9 illustrate perspective views of a cooler including a refrigerant bunker in different positions, according to an embodiment of the present disclosure.
Figure 9:
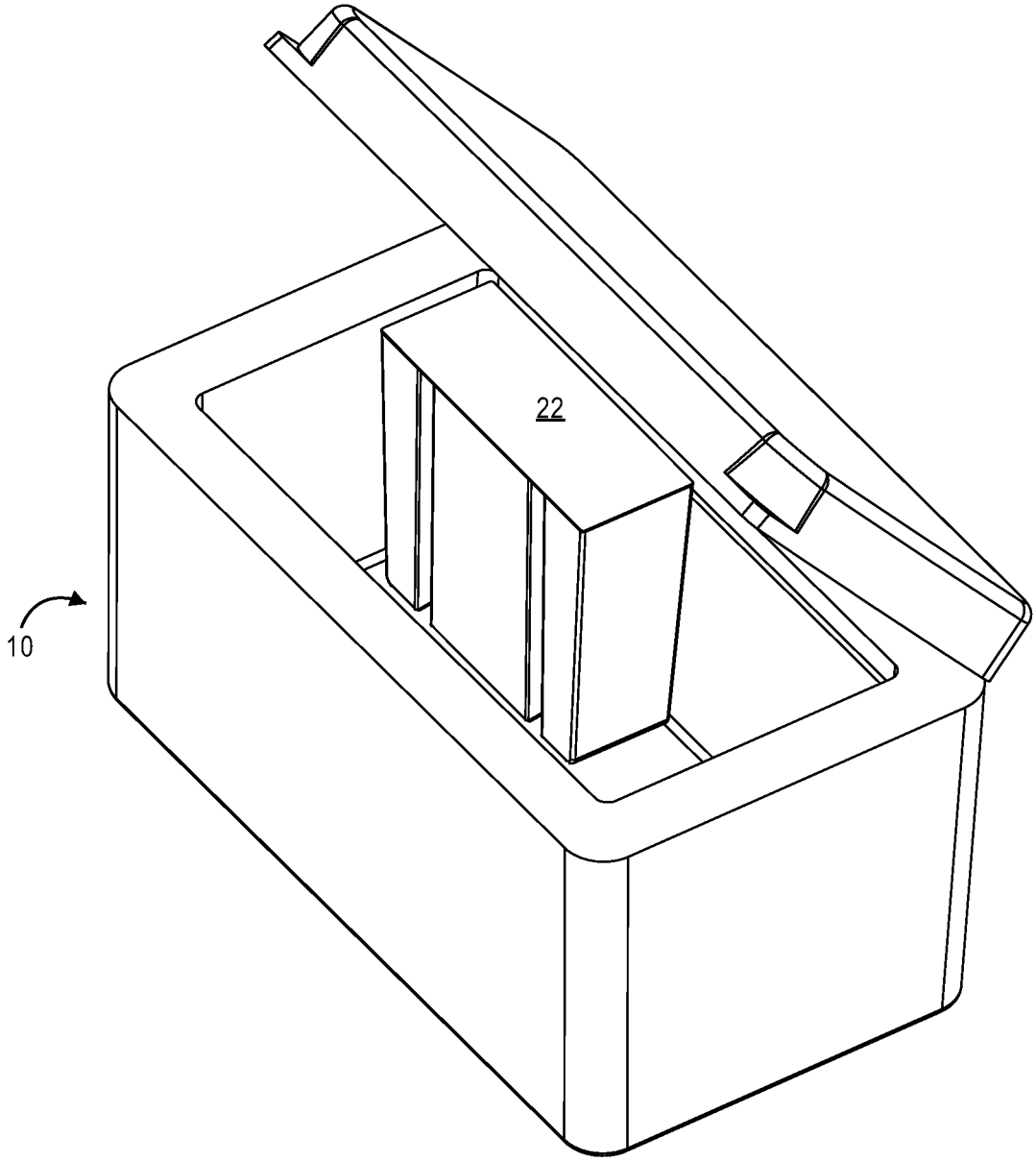

In an embodiment, refrigerant bunkers 22 are configured for placement and/or mounting within a portable insulated, personal cooler or commercial shipping container, and can be sold either with the coolers or separately from the coolers. The refrigerant bunkers of the present disclosure can be included in the cooler 10 in any suitable manner. In an embodiment, the refrigerant bunker 22 can simply be placed in any desired fixed or non-fixed position in the cooler chamber 12 by a user, such as is shown in FIGS. 8 and 9. For example, refrigerant bunker 22 can be positioned in the cooler adjacent to the front wall, back wall or side walls, or on the bottom to act as a false bottom.

In an alternative embodiment, all or a portion of the refrigerant bunker 10 can be made an integral part of a cooler 10. For example, the outer container 26 of the refrigerant bunker can be integrated into the lid 14, as illustrated in any of FIG. 10, 11 or 12. In an embodiment, refrigerant bunkers can be configured as replacement lids for pre-existing coolers and/or are designed to repurpose existing coolers.

Figure 10:
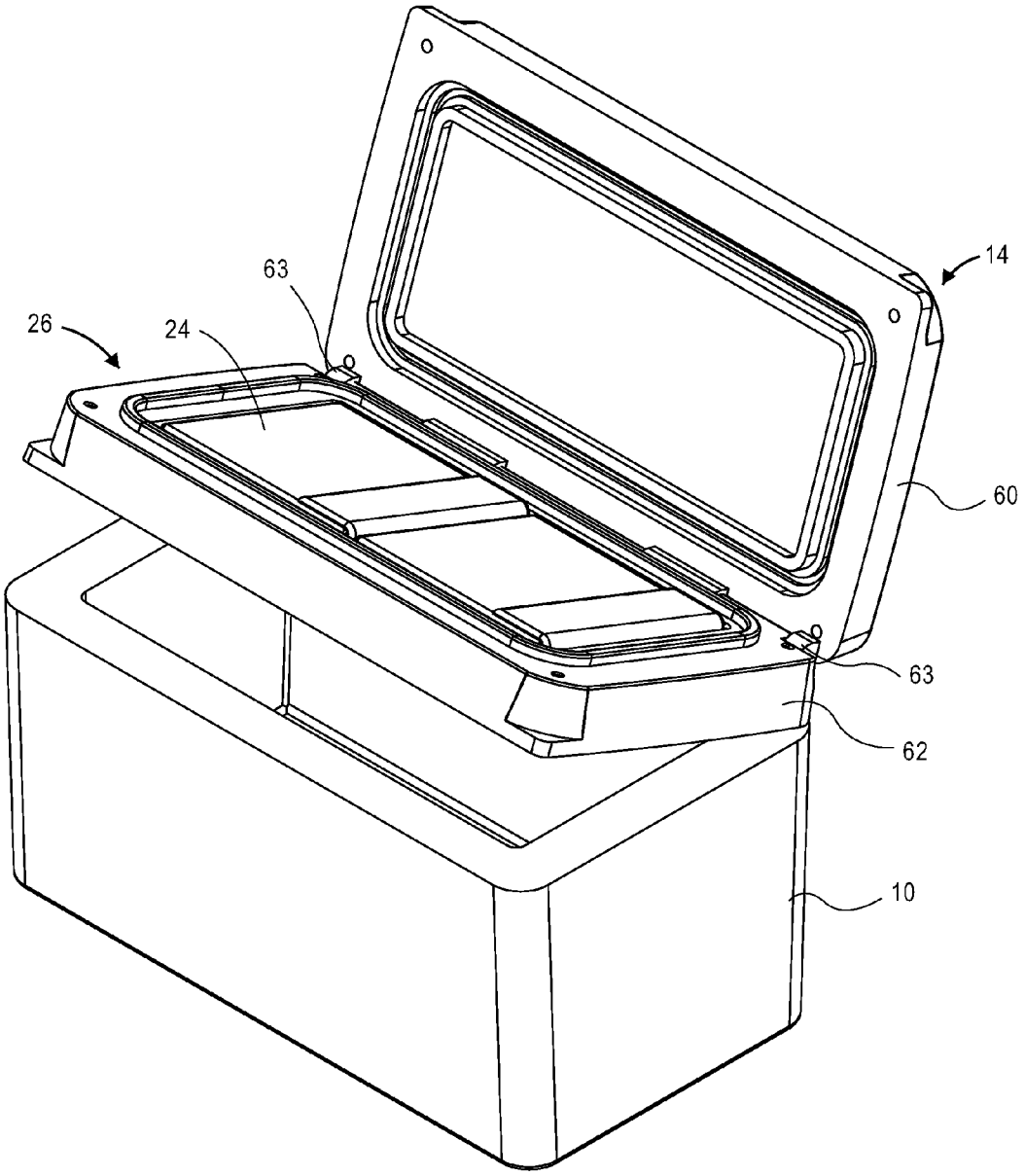
FIG. 10 illustrates a perspective view of a cooler including a refrigerant bunker integrated into the lid, according to an embodiment of the present disclosure.

FIG. 10 shows lid 14 comprising an upper portion 60 and a lower portion 62 that is engagable with the upper portion 60 to form an enclosed space between the upper portion 60 and lower portion 62. The enclosed space can be sized to hold an inner refrigerant cover 24. Upper portion 60 and lower portion 62 can be attached together in any suitable manner, such as by using one or more hinges 63. The lower portion 62 can include spacers (not shown) positioned on the bottom and or sides of the enclosed space, similar to, for example, the spacers 42 shown in FIG. 3A, or those shown in FIGS. 11 and 12, described below. FIG. 10 illustrates two inner refrigerant covers 24 positioned in the outer container 26. As with any of the refrigerant bunkers described herein, any number of inner refrigerant covers 24 can be included in the outer container 26 formed by lid 14, such as one, two, three or more.

Figure 11:
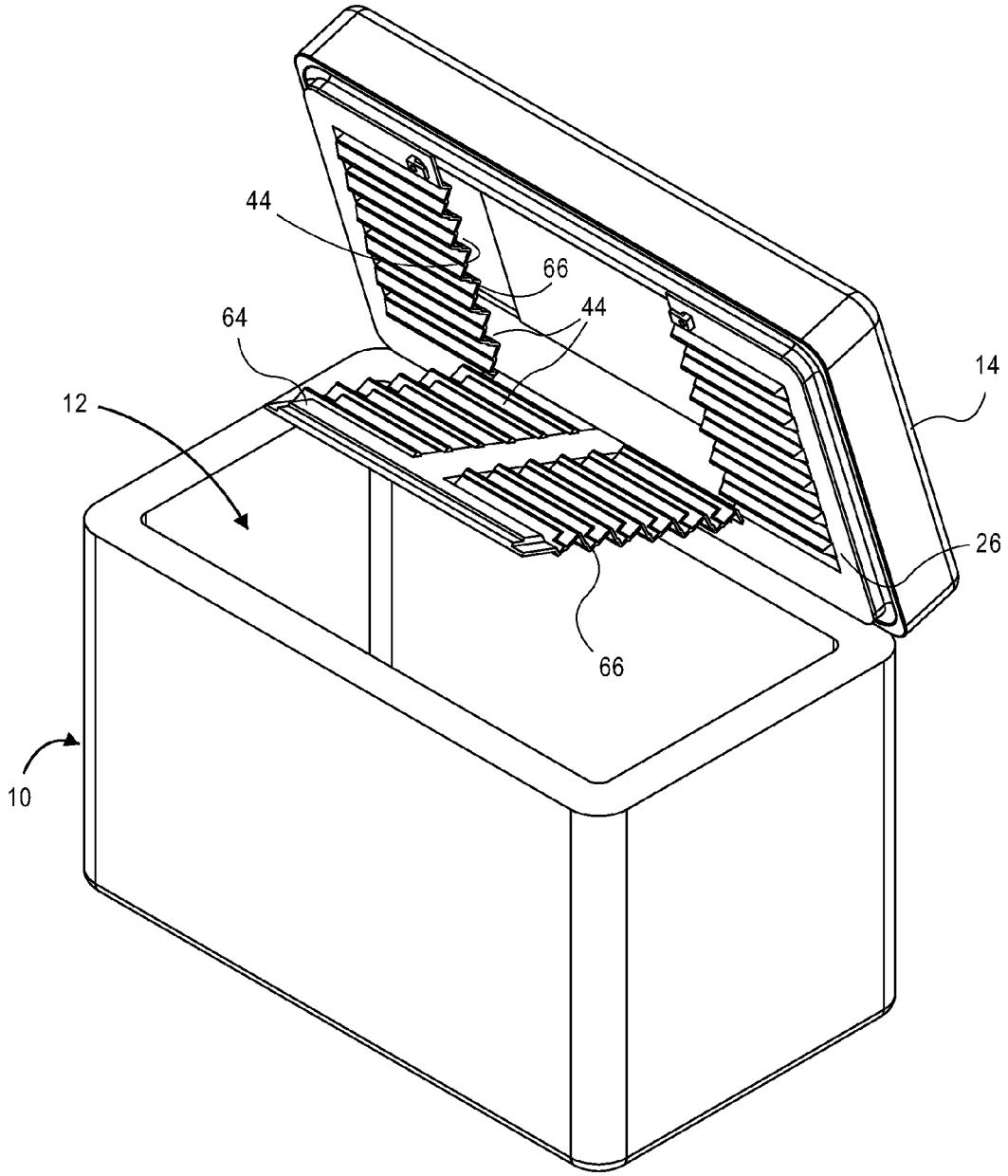
FIG. 11 illustrates a perspective view of a cooler including a refrigerant bunker integrated into the lid, according to an embodiment of the present disclosure.
Figure 12:
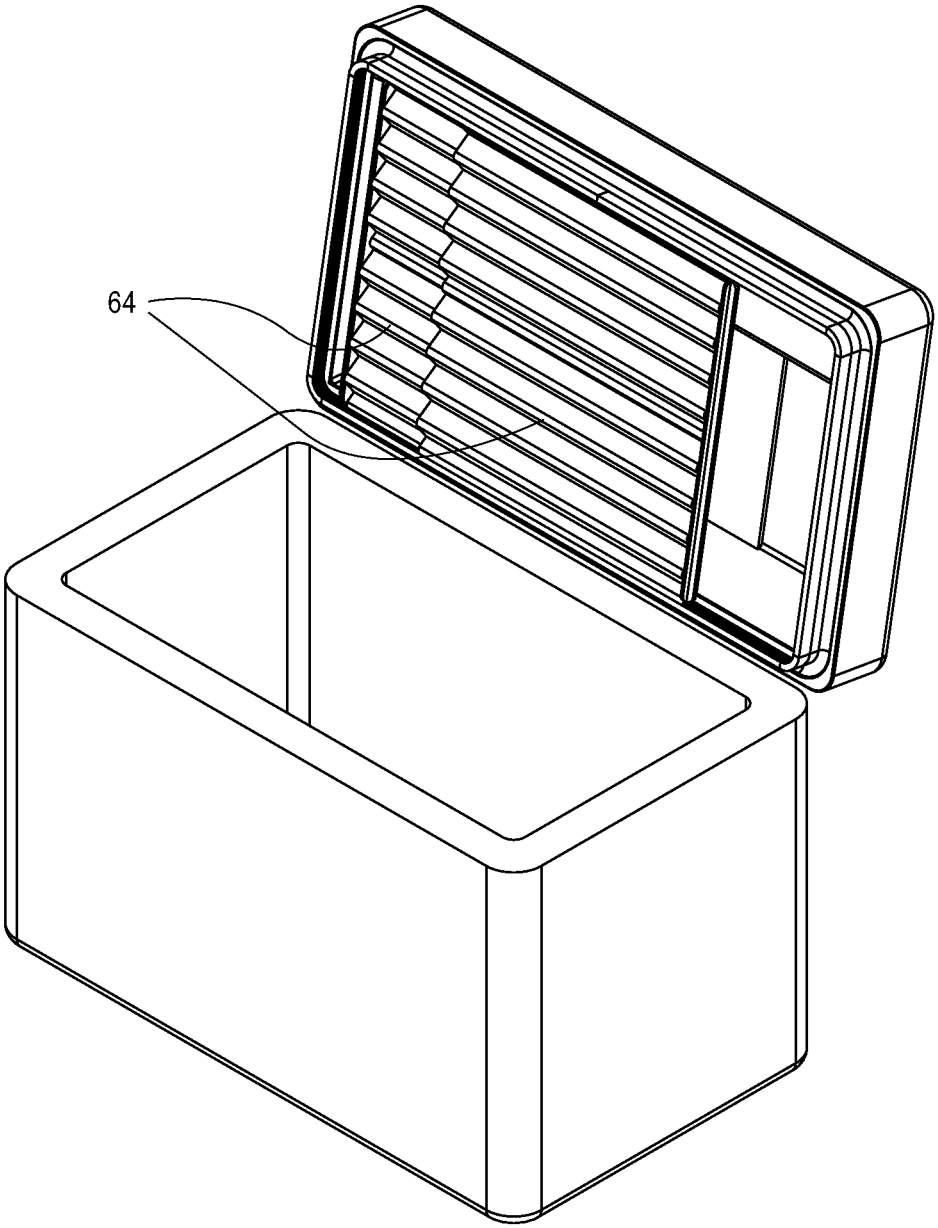
FIG. 12 illustrates a perspective view of a cooler including a refrigerant bunker integrated into the lid, according to an embodiment of the present disclosure.

FIG. 11 illustrates an alternative design in which a lid 14 comprises a door 64 that provides access to outer container 26 into which one or more inner refrigerant covers 24 can be inserted. In an embodiment, a corrugated or ribbed material 66 can be employed as an inner surface of the outer container 26, including the door 64, between the chamber 12 of cooler 10 and the inserted inner refrigerant cover containing refrigerant (not shown). The corrugated material 66 can function to provide gas filled gaps 44 during operation of the cooler, as discussed herein above. FIG. 12 illustrates a similar design to that of FIG. 11, except that one or more sliding doors 64 are employed instead of the hinged door shown in FIG. 11.

Figure 13:
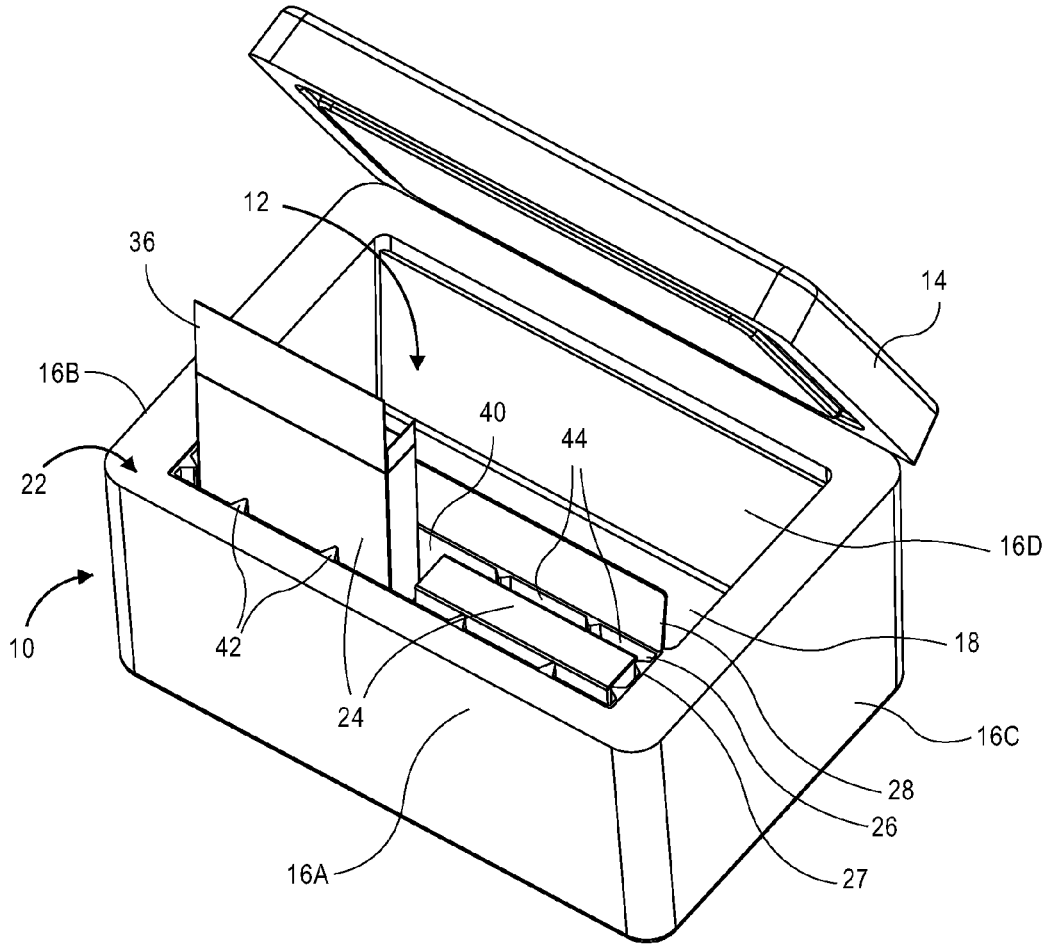
FIG. 13 illustrates a perspective view of a cooler including a refrigerant bunker integrated into the side, according to an embodiment of the present disclosure.

FIG. 13 illustrates a cooler 10 in which the outer container 26 of the refrigerant bunker 22 is integrated into a side of the cooler 10. Outer container body 27 includes an inner surface 40 formed between a side 16A and a dividing wall positioned between the side 16A and chamber 12 of cooler 10. The inner surface 40 defines a partially enclosed space for holding one or more inner refrigerant covers 24. A plurality of spacers 42 extend between the inner refrigerant covers 24 and the outer container 26 when the inner refrigerant covers are inserted into the container so as to form gaps 44 between the spacers. An outer container cover 28 of the bunker can be attached to cooler 10 so as to open to allow access to, and close to cover, the enclosed space, in any suitable manner, such as by using one or more hinges (not shown). While the refrigerant bunker is shown as being integrated into a front side 16A of the cooler 10, the refrigerant bunker can be integrated into any part of cooler 10, such as any one or more of front side 16A, side 16B, side 16C, back side 16D, bottom 18 or lid 14.

The refrigerant bunkers of the present disclosure can be used with any sized cooler, such as portable coolers or commercial coolers. In an embodiment, the cooler has a total internal capacity (e.g., volume of chamber 12) of about 150 quarts or less, such as about 8 quarts to about 140 quarts, or about 20 quarts to about 120 quarts, or about 40 quarts to about 100 quarts.

The refrigerant bunkers 22 of the present disclosure can thus employ appropriate level of insulation to reduce, as desired, the transfer of thermal energy from the interior of the cooler 10 to the refrigerant 32. This is accomplished by using a combination of the space in the refrigerant bunker, such as the gaps 44, the inner refrigerant cover material properties and the layers of sublimated carbon dioxide that fills the space of the outer container and/or inner refrigerant cover to achieve this desired level of thermal shielding. This may help reduce the amount of expensive, heavy and/or bulky insulation or the use of expensive vacuum insulated panels used to achieve a similar level of thermal resistance. This may also allow a reduced size and/or cost of the refrigerant bunkers of the present disclosure.

The present disclosure is also directed to a method for controlling the temperature of a cooler. The method comprising inserting dry ice into any of the refrigerant bunkers of described herein. In an embodiment, the dry ice is enclosed in the refrigerant covering and the outer container. The refrigerant bunker is maintained in a cooler having a chamber, such as any of the coolers described herein. The refrigerant bunker is positioned so that the dry ice cools the chamber. In an embodiment, the cooler can be maintained at temperatures suitable for refrigeration, such as above 32° F. to about 40° F., or 33° F. to about 38° F. As described herein, a user can optionally maintain the temperature at below freezing temperatures, e.g., below 32° F., by inserting the dry ice into the refrigerant bunker without the refrigerant covering.

EXAMPLES

A refrigerant bunker was made from foam insulation with an R-5 insulation value and a plastic lid. Spacers were positioned in the bottom and sides of the foam bunker to provide an offset, $D_o$, of about ⅜ inch. Holes of about ⅜ inch diameter were made in the bunker to act as convection ports for testing purposes. A 10×10×2 inch block of dry ice was used as a coolant. Several pages of crinkled paper were wrapped around the dry ice as an inner refrigerant cover during portions of the testing.

Testing included positioning dry ice in the foam bunker. The bunker containing the dry ice was placed in a rotationally molded, 50 quart cooler and the temperature inside the cooler was measured over a period of 24 hours. Separate tests were run in which 1) the convection ports in the bunker were opened and no paper inner refrigerant cover was wrapped around the dry ice; 2) the convection ports were closed and no paper inner refrigerant cover was wrapped around the dry ice; and 3) the convection ports were closed and a paper inner refrigerant cover was wrapped around the dry ice.

Figure 14:
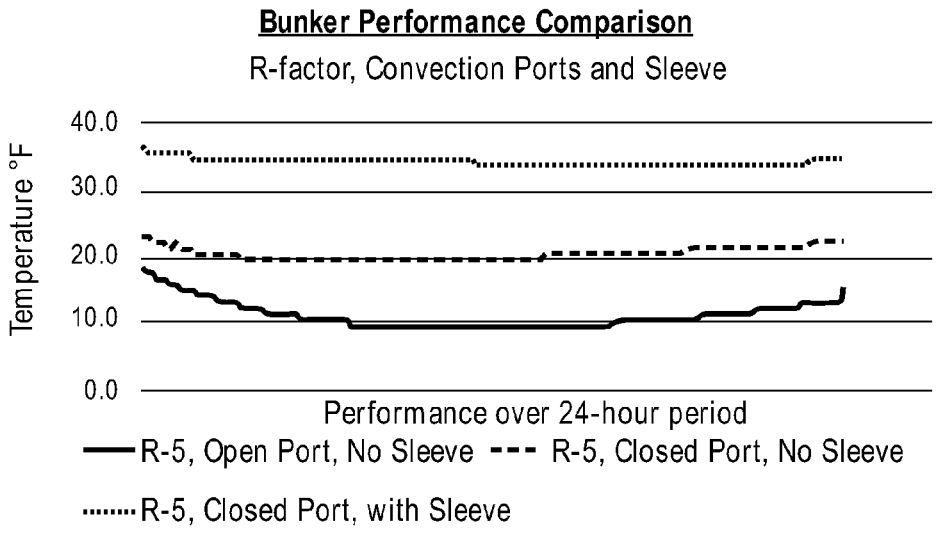
FIG. 14 shows a graph of temperature data collected during testing of a refrigerant bunker, as described in examples of the present disclosure.

The results of the tests are shown in the graph of FIG. 14. As can be seen from the graph, when the paper inner refrigerant cover was not used, temperatures in the cooler dropped below freezing when the convection ports were opened or closed. When the paper inner refrigerant cover was employed, the temperature in the cooler remained above freezing, such as above 33° F. and below 40° F. (a range that was suitable for use as refrigeration) for the 24 hour period. Thus, the data shows that use of an inner refrigerant cover with dry ice can substantially increase the insulating ability of the refrigerant bunker.

Other testing was performed in which the size of the ribbing was reduced to produce a smaller offset (offset decreased from ⅜" to ⅛") and the paper inner refrigerant cover was tightly wrapped around the dry ice. This resulted in less effective insulation properties for the bunker that in turn resulted in below freezing temperatures in the cooler. It is hypothesized that the decrease in insulation performance was due to reduced carbon dioxide gas-layering potential of the bunker caused by the smaller offset and tightly wrapped inner paper cover.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompasses by the following claims.

What is claimed is:

1. A refrigerant bunker configured for use with a portable cooler, the refrigerant bunker comprising:

a refrigerant covering comprising a first thermally insulating material configured to enclose a solid refrigerant, the first thermally insulating material of the refrigerant covering being in a form of a sleeve configured to hold the solid refrigerant; the refrigerant covering further comprising an opening for inserting the solid refrigerant into the sleeve and a sleeve cover for covering the sleeve opening;

an outer container comprising a container body and a container cover, the container body comprising an outer surface; an inner surface defining a partially enclosed space and an opening for accessing the partially enclosed space, the enclosed space configured to accept the solid refrigerant enclosed in the refrigerant covering, the container cover configured for covering the container opening, the container body comprising a second thermally insulating material; and a plurality of spacers protruding from the inner surface of the outer container in the partially enclosed space, the plurality of spacers positioned to have gas fillable gaps between the spacers, the gas fillable gaps having a depth, Do, that ranges from about ¼ inch to about 2 inches.

2. The refrigerant bunker of claim 1, wherein the container body extends between the plurality of spacers so that the outer container completely surrounds the space configured to accept the solid refrigerant when the container cover is positioned to cover the container opening.

3. The refrigerant bunker of claim 2, wherein the container body does not include a ventilation port.

4. The refrigerant bunker of claim 2, wherein the refrigerant bunker comprises a pressure release mechanism to vent over-pressurization of a sublimated gas from the outer container, the pressure release mechanism being selected from the group consisting of a pressure regulating valve, a leak path between the container cover and container body, and a combination thereof.

5. A refrigerant bunker, comprising:

a refrigerant covering comprising a first thermally insulating material configured to enclose a solid refrigerant;

an outer container comprising a container body and a container cover, the container body comprising an outer surface, an inner surface defining a partially enclosed space configured to accept the solid refrigerant and an opening for accessing the partially enclosed space, the container cover configured for covering the container opening, the container body comprising a second thermally insulating material; and a plurality of spacers protruding from the inner surface of the outer container in the partially enclosed space, the plurality of spacers positioned to have gas fillable gaps between the spacers, the gas fillable gaps having a depth, Do, that ranges from about ¼ inch to about 2 inches.

6. The refrigerant bunker of claim 5, wherein the refrigerant bunker is configured for use with a portable cooler.

7. The refrigerant bunker of claim 5, wherein the first thermally insulating material of the refrigerant covering is in a form of a sleeve configured to hold a solid refrigerant, the refrigerant covering further comprising an opening for inserting the solid refrigerant into the sleeve and a sleeve cover for covering the sleeve opening.

8. The refrigerant bunker of claim 7, wherein the sleeve is removable from the outer container.

9. The refrigerant bunker of claim 5, wherein the refrigerant covering is in a form of a wrap configured to completely enclose the solid refrigerant.

10. The refrigerant bunker of claim 5, wherein the second thermally insulating material is plastic.

11. The refrigerant bunker of claim 5, wherein the plurality of spacers are integral with the outer container.

12. The refrigerant bunker of claim 5, wherein the refrigerant covering is fixedly attached to the outer container.

13. The refrigerant bunker of claim 5, wherein the outer container comprises a pliable material.

14. The refrigerant bunker of claim 5, wherein the container body extends between the plurality of spacers so that the outer container completely surrounds the space configured to accept the solid refrigerant when the container cover is positioned to cover the container opening.

15. The refrigerant bunker of claim 14, wherein the spacers are made of the same insulating material as that of the container body.

16. The refrigerant bunker of claim 14, wherein the container body does not include a ventilation port.

17. The refrigerant bunker of claim 14, wherein the refrigerant bunker comprises a pressure release mechanism to vent over-pressurization of a sublimated gas from the outer container, the pressure release mechanism being selected from the group consisting of a pressure regulating valve, a leak path between the container cover and container body, and a combination thereof.

18. A method for controlling a temperature of a cooler, the method comprising:

inserting dry ice into a refrigerant bunker, the refrigerant bunker comprising:

a refrigerant covering comprising a first thermally insulating material configured to enclose a solid refrigerant;

an outer container comprising a container body and a container cover, the container body comprising an outer surface, an inner surface defining a partially enclosed space configured to accept the solid refrigerant and an opening for accessing the partially enclosed space, the container cover configured for covering the container opening, the container body comprising a second thermally insulating material; and a plurality of spacers protruding from the inner surface of the outer container in the partially enclosed space, the plurality of spacers positioned to have gas fillable gaps between the spacers, the gas fillable gaps having a depth, Do, that ranges from about ¼ inch to about 2 inches, the dry ice being enclosed in the refrigerant covering and the outer container; and maintaining the refrigerant bunker in a cooler having a chamber, the refrigerant bunker being positioned so that the dry ice cools the chamber.

19. The method of claim 18, wherein carbon dioxide gas from the dry ice remains trapped in the container body so as to fill the gas fillable gaps and surround the refrigerant covering.

20. The method of claim 18, wherein the primary mechanism for cooling employed when using refrigerant bunker is by conduction through the outer container and refrigerant covering.

* * * * *